US006550081B2

(12) United States Patent
Vilsmeier

(10) Patent No.: US 6,550,081 B2
(45) Date of Patent: Apr. 22, 2003

(54) LIFT BED WITH BELT DRIVE

(76) Inventor: Gerhart W. Vilsmeier, Bussardweg 42, Aschaffenburg (DE), 63741

( * ) Notice: Subject to any disclaimer, the term of this patent is extended or adjusted under 35 U.S.C. 154(b) by 0 days.

(21) Appl. No.: 09/953,337

(22) Filed: Sep. 14, 2001

(65) Prior Publication Data

US 2002/0046423 A1 Apr. 25, 2002

(30) Foreign Application Priority Data

Oct. 30, 2002 (EP) ..... 00123670

(51) Int. Cl.[7] ..... A47C 17/84; A47C 31/00
(52) U.S. Cl. ..... 5/11
(58) Field of Search ..... 5/11, 133

(56) References Cited

U.S. PATENT DOCUMENTS

| | | | | |
|---|---|---|---|---|
| 4,837,877 A | * | 6/1989 | Hamada et al. | 5/11 |
| 5,020,169 A | * | 6/1991 | Hamada et al. | 5/11 |
| 5,056,170 A | * | 10/1991 | Kronshagen | 5/11 |
| 5,363,520 A | * | 11/1994 | Lyne, Jr. | 5/11 |
| 5,502,850 A | * | 4/1996 | Lyne, Jr. | 5/11 |

FOREIGN PATENT DOCUMENTS

| | | | | |
|---|---|---|---|---|
| AU | 359680 | | 11/1980 | 12/10 |
| DE | 34 43 334 | * | 11/1984 | 5/11 |
| DE | 3827300 | | 2/1989 | 17/84 |
| EP | 418 415 | * | 9/1989 | 5/11 |

* cited by examiner

*Primary Examiner*—Frederick L. Lagman
(74) *Attorney, Agent, or Firm*—Darby & Darby

(57) ABSTRACT

A lift bed has a vertically adjustable bed frame and a pulling device for moving the bed frame in the vertical direction. The lift bed includes two carriages which has secured to an end face of the bed frame horizontally spaced from one another, each of said carriages being supported such that it is movable on a vertical guide rail by means of rollers. The carriages are connected via a pull chain or a toothed belt to a counterweight and each pull chain or each toothed belt is guided over a drive wheel at the upper end of the respective guide rail. The drive wheels are rigidly coupled via a coupler rod; the coupler rod is connected to a main reel which is arranged in vertically spaced relationship with a counterreel with the main reel and the counterreel being interconnected by a drive belt, the drive belt being used for rotatably driving the coupler rod; an the counterreel is adapted to be driven selectively in one direction or the other by a motor coupled to a reduction gearing and used for rotating the coupler rod.

8 Claims, 4 Drawing Sheets

LIFT BED WITH BELT DRIVE

FIELD OF THE INVENTION

The present invention relates to a lift bed.

BACKGROUND OF THE INVENTION

EP-B1-0 418 415 discloses a suspended bed with a vertically adjustable bed frame and a lifting device for moving the bed frame in the vertical direction. The suspended bed comprises a vertically extending guide means which is secured to the wall and on which one end face of the bed frame is supported such that it is movable in the vertical direction. The lifting device is provided with a self-locking drive and it is implemented and arranged in such a way that it acts on the above-mentioned end face of the bed frame.

The lifting device is provided with at least one electric motor for driving self-locking lifting spindles, a crank being provided for emergency operation; this crank is adapted to be coupled to the lifting spindles and it is in mesh therewith when the crank is rotated.

The suspended bed described in EP-B1-0 418 415 takes up very little space and it is safe in operation. In particular, if the lifting device is arranged in the area of the guide means, practically no floor space is occupied, when the suspended bed has been raised to the position below the ceiling. In addition, the self-locking drive permits the suspended bed to be supported reliably and vibration-free at any vertical position.

BRIEF DESCRIPTION OF THE INVENTION

Starting from the known prior art, it is the object of the present invention to provide a lift bed which offers higher operational comfort.

The present object is, in particular, achieved by a lift bed comprising a vertically adjustable bed frame and a pulling device for moving said bed frame in the vertical direction, said lift bed comprising two carriages which are secured to an end face of the bed frame such that they are horizontally spaced from one another, each of said carriages being supported such that it is movable on a vertical guide rail by means of rollers, said two carriages being each connected via a pull chain or a toothed belt to a counterweight; each pull chain or each toothed belt is guided over a drive wheel at the upper end of the respective guide rail; the drive wheels are rigidly coupled via a coupler rod; the coupler rod is connected to a main reel which is arranged in vertically spaced relationship with a counterreel; the main reel and the counterreel are interconnected by a drive belt, said drive belt being used for rotatably driving the coupler rod; and the counterreel is adapted to be driven selectively in one direction or the other by means of a motor coupled to a reduction gearing and used for rotating the coupler rod.

The present invention is based on the finding that the lift bed disclosed is very easy to operate and, in particular, that it makes extremely little noise when in operation. In addition, a suitable structural design of the counterweights according to the present invention permits the use of an energy-saving motor.

The preferred embodiment has the advantage that the main reel and the counterreel can be installed in a countersunk mode and that the part of the drive belt extending between said main reel and said counterreel can, via respective guide means, be attached such that it is freely accessible for possible operation by hand. It follows that, e.g. in the case of power failure, the lift bed can be moved manually from one vertical position to another and will therefore be operable in any case.

A further development has the advantage that the drive motor is implemented as a tube motor and can therefore be arranged e.g. in the interior of the counterreel. The counterreel and the drive motor can be combined in a space-saving manner in this way.

Still another development has the advantage that the motor coupled to the reduction gearing is implemented as a self-locking component.

Another development has the advantage that the motor is implemented such that its rated power does not exceed 100W, i.e. it operates in an energy-saving mode.

A further development has the advantage that the carriages are each bipartite, each part comprising at least one roller and the two parts of a carriage being interconnected in such a way that one part is adapted to be tilted relative to the other part about a horizontal axis extending parallel to the coupler rod.

A further development has the advantage that each carriage is provided with an adjusting device by means of which the two parts can be adjusted relative to one another. Hence, the bed can easily be oriented horizontally, i.e. parallel to the floor, by adjusting the carriages in a suitable manner.

A further development has the advantage that the mass of the counterweight exceeds that of the bed frame. The bed frame can therefore be moved vertically upwards without any necessity of driving the coupler rod by the drive motor or by a user by means of the drive belt.

Another development has the advantage that the mass of the counterweight is less than that of the bed frame so that, when the coupler rod is released, the bed frame will move automatically downwards in the vertical direction.

DETAILED DESCRIPTION OF THE INVENTION

Figure 1:
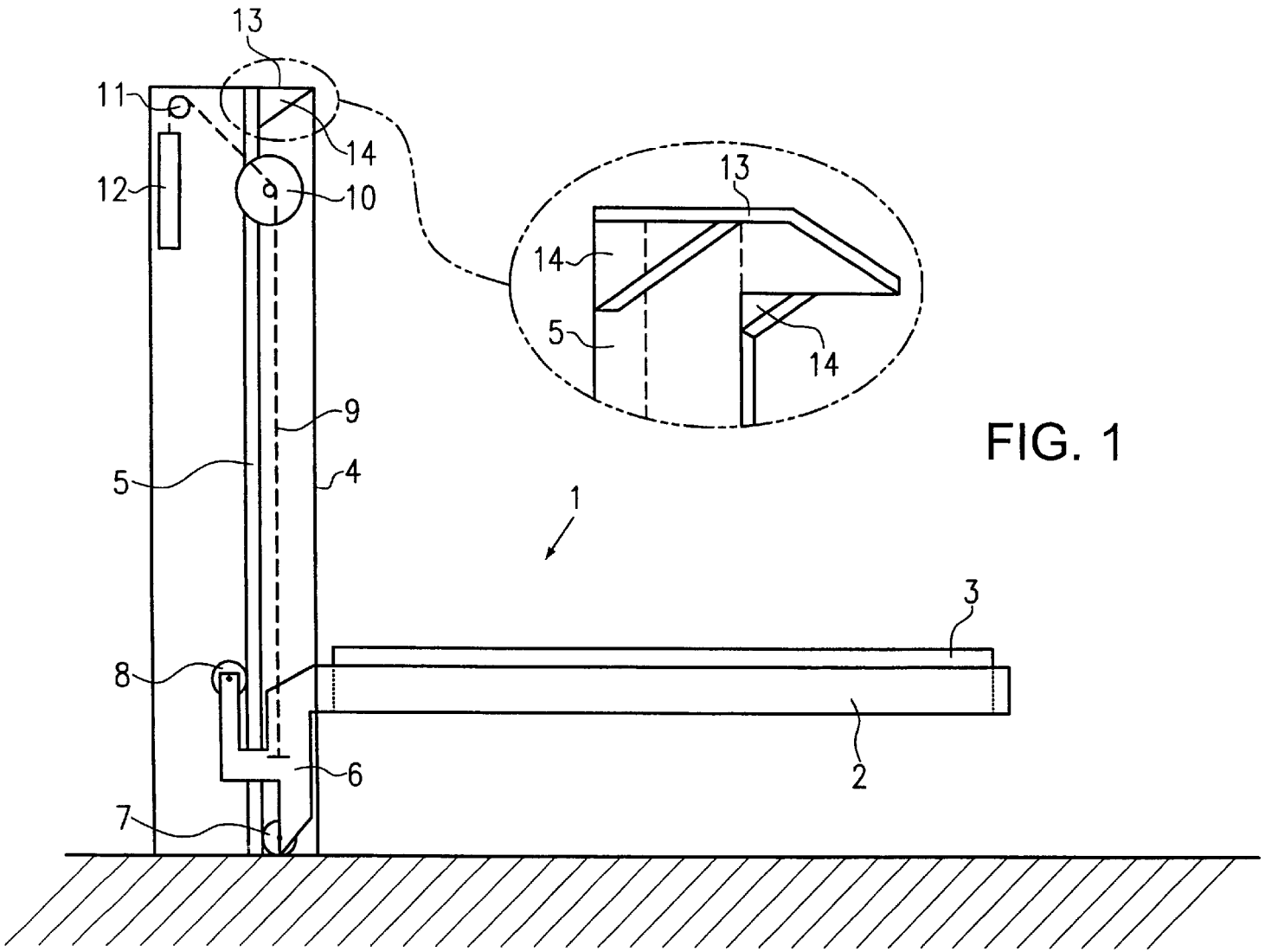
FIG. 1 a schematic side view of lift bed according to the present invention.

FIG. 1 shows a schematic side view of a lift bed 1 comprising a bed frame 2, an exemplarily outlined mattress 3, and a guide means 4. The guide means 4 comprises a vertical guide rail 5 on which a carriage 6, which is rigidly connected to the bed frame 2, can be moved vertically up and down. In order to permit this up and down movement, the carriage is movably supported on the guide rail 5 via rollers 7 and 8 and connected to a counterweight 12 by means of a pull chain 9 via a deflection pulley 10, which is preferably arranged in the vicinity of the upper end of guide rail 5, and via a sprocket wheel 11. The sprocket wheel 11 can, in particular, be arranged at the upper end of the guide rail where it will then carry out the function of the deflection pulley 10.

According to another variant, the pull chain 9 can be replaced by a toothed belt, the sprocket wheel 11 being then implemented by a suitable drive wheel for driving said toothed belt.

According to a preferred embodiment of the present invention, the lift bed 1 according to the present invention comprises two vertical guide means 4 which are arranged parallel to one another and at a distance from one another equal to a bed-frame width, said vertical guide means 4 being preferably secured to a load-carrying wall of a room by means of suitable screws. Each guide rail 5 of the guide means 4 is preferably implemented as a T-beam having a length that corresponds to the room height. The upper and the lower end of the T-beam have secured thereto a head plate 13 and a base plate, which is not shown; said head and base plates are arranged substantially at right angles to the T-beam side opening towards the bed frame 2 and they extend along a load-carrying ceiling and a load-carrying floor, respectively. The head plate 13 and the base plate secured to the T-beam preferably have a length of 30 cm each.

The fact that each guide rail 5 is provided with such a base guarantees that tilting over of the guide rail 5 into the room is almost impossible, provided that the guide rail 5 is not secured in position, since due to the fact that the bend-proof base rests on the floor, the axis of rotation extending parallel to the floor/wall edge will be displaced parallel to the end face of the base. This, however, has the effect that the guide rail 5, which extends up to the ceiling, can no longer tilt over into the room, since, due to the displacement of the axis of rotation relative to the end face of the base, the head plate 13 of the guide rail 5 will be pressed against the ceiling in the case of a tilting movement.

By means of this structural design of the guide rail 5, a self-locking tilting mechanism is created, which will block said guide rail 5 if it should tilt. In order to prevent the head plate 13 and the base plate from bending, two substantially right-angled triangles 14 are provided for each head plate 13 and base plate for supporting said head and base plates, the two triangles 14 being arranged at a distance equal to the width of the guide rail 5 in such a way that one side of the right-angled triangle 14 is connected to the complementary side of the guide rail 5 and the other side of the right-angled triangle 14 is connected to the head plate 13 or the base plate. The head plate 13 and the base plate may, however, also be formed integrally with the two triangles 14.

According to a specially preferred embodiment of the present invention, the base plate is implemented such that it is adapted to be sunk into the floor below the lift bed 1 and that it preferably extends from the wall having the guide means 4 secured thereto up to the opposite wall. In addition, the base plate can be replaced by two tubes or rods which are attached to the lower sides of the respective triangles 14, i.e. the triangle edges facing the floor.

On the two bed-frame corners of the bed frame 2 which are located on the end face of the bed frame 2 facing the wall, a respective carriage 6 is formed, each carriage 6 being connected to a counterweight 12 via a pull chain 9 guided over a deflection pulley 10 and/or a sprocket wheel 11. The two sprocket wheels 11 are preferably rigidly coupled via a coupler rod so as to guarantee a synchronous rotation of the two sprocket wheels 11.

In the embodiment shown in FIG. 1, the lift bed 1 is in the so-called night mode, i.e. the bed frame 2 is located in the vicinity of the floor. In order to move the bed frame 2 vertically upwards so as to bring it e.g. to the highest possible vertical position, the so-called day mode, the sprocket wheels 11 are preferably rotated so that the counterweights 12 are moved vertically downwards, whereby the bed frame 2 is moved vertically upwards by means of the carriages 6 along the guide rails 5. In order to prevent the bed frame 2 from being moved inadvertently from the night mode to the day mode, the sprocket wheels 11 or the coupler rod are preferably adapted to be blocked in the night mode.

If the bed frame 2 is to be moved from the night mode to the day mode, the sprocket wheels 11 are released and rotated in such a way that the bed frame 2 will move upwards, whereas the counterweights 12 move vertically downwards.

The counterweights 12 are preferably implemented in such a way that the sum of their masses is larger than the mass of the bed frame 2 so that, if the lift bed 1 is in the night mode, a release of the sprocket wheels 11 will result in an upward movement of the bed frame 2 due to the fact that the sum of the gravitational forces acting on the counterweights 12 exceeds the gravitational force acting on the bed frame 2. It follows that no effort e.g. on the part of a user of the lift bed 1 will be necessary for moving the bed frame 2 from the night mode to the day mode. In order to move the bed frame 2 from the day mode to the night mode, an external force must act on the bed frame 2 or the counterweights 12 so that the above-described balance of forces changes in favour of the bed frame 2 so that a downward movement of the bed frame 2 can be caused.

According to a specially preferred embodiment of the present invention, the lift bed 1 moves automatically to the night mode or rather remains in said night mode when the mass of the bed frame 2 is increased. Hence, the bed frame 2 cannot be moved to the day mode if a person lies on the bed, whereby accidents can be avoided.

Figure 2:
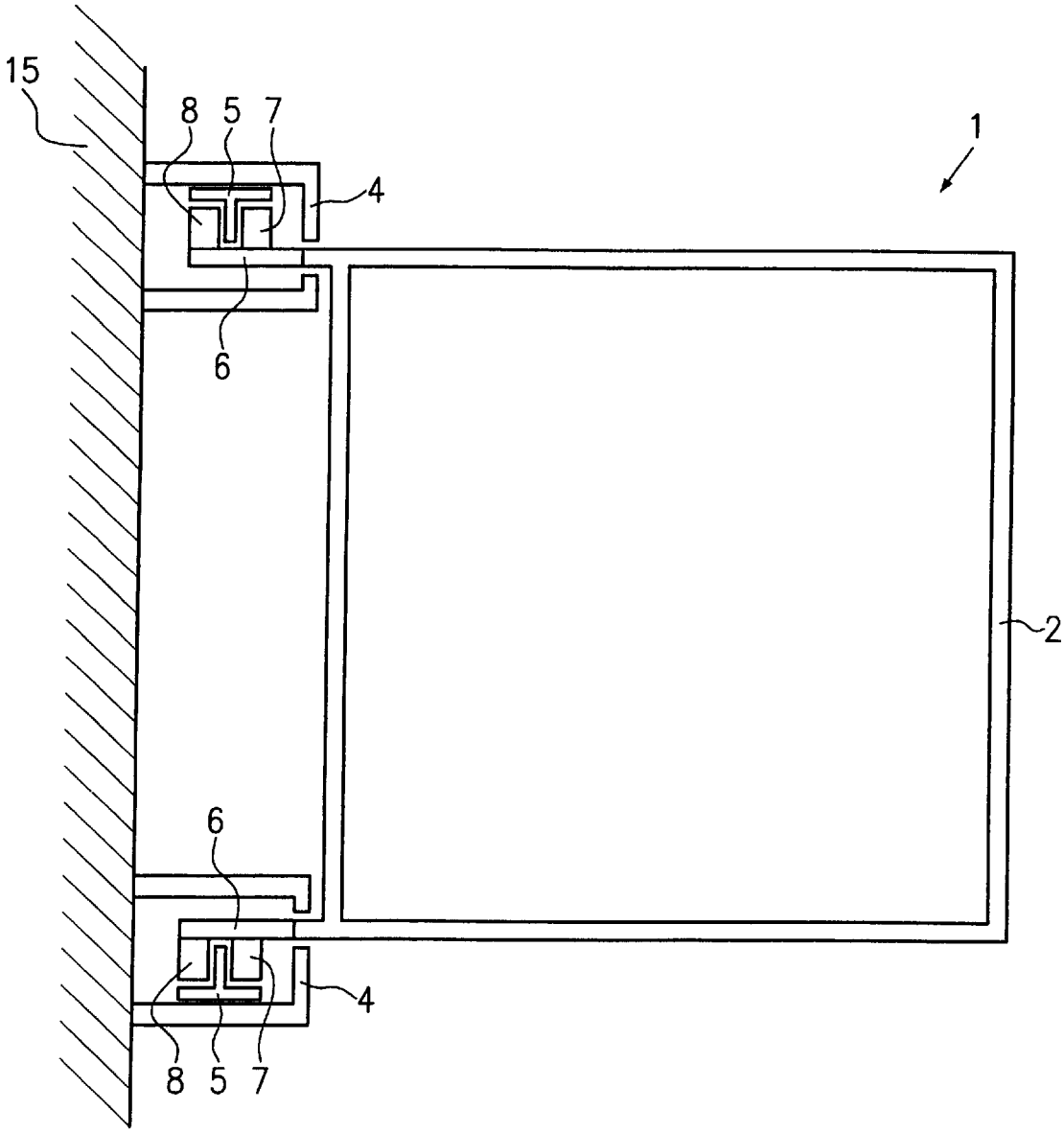
FIG. 2 a schematic top view of a lift bed according to FIG. 1.

FIG. 2 shows a schematic top view of the lift bed 1 according to FIG. 1 so as to elucidate the structural design of the guide means 4. The two guide means 4 of the lift bed 1 are secured to a wall 15 parallel to one another and at a distance from one another which is substantially equal to a bed-frame width. A guide rail 5 in the form of T-beam is implemented in each of said guide means 4. On opposite sides of said T-beam, the rollers 7, 8 of the respective carriage 6 are movably supported, said two carriages 6 being both secured to two bed-frame corners of the bed frame 2 which are located on the end face of the bed frame 2 facing the wall.

Figure 3:
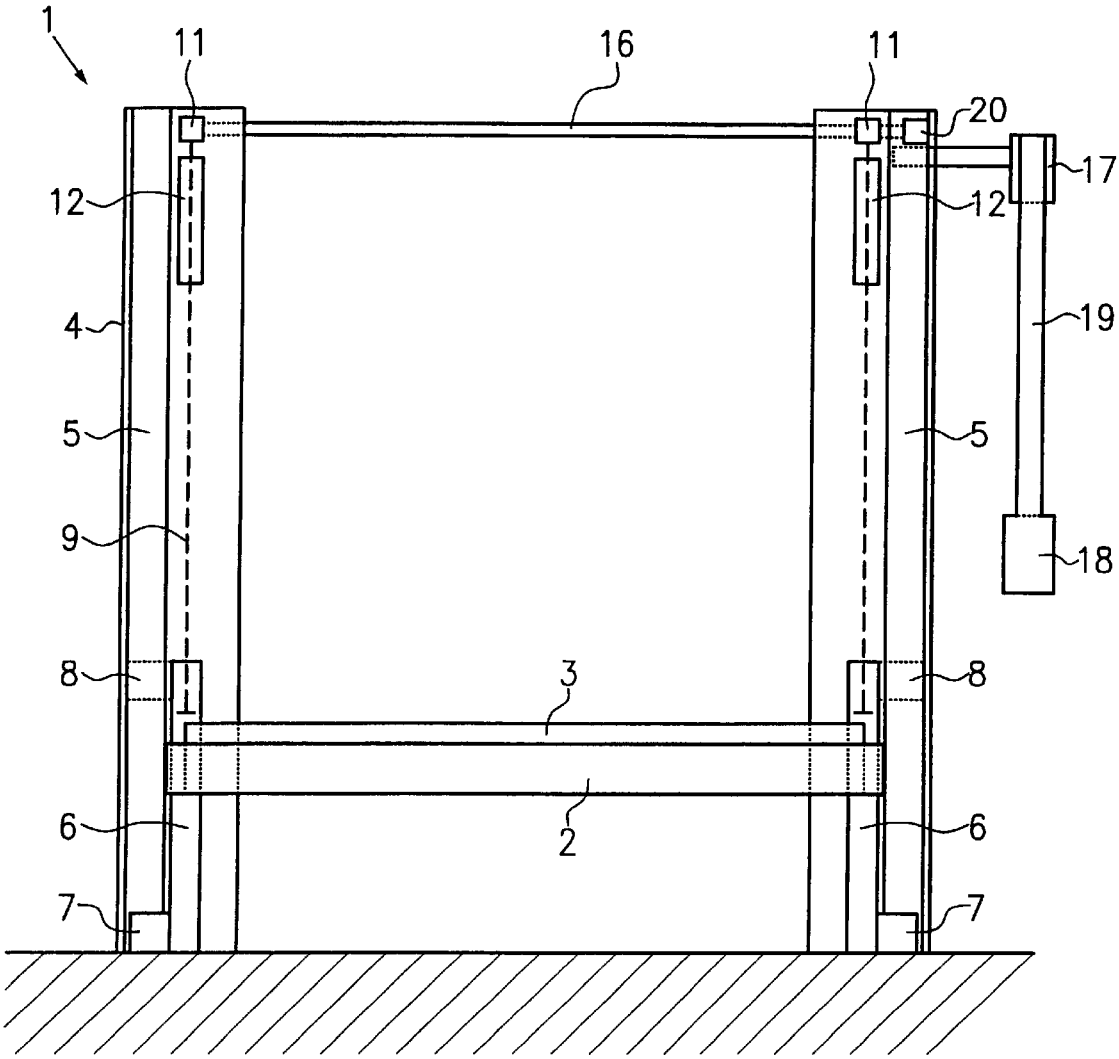
FIG. 3 a schematic front view of a lift bed according to FIG. 1, the belt drive being indicated in said front view.

FIG. 3 shows a schematic front view of the lift bed 1 according to FIG. 1 including an exemplary representation of a belt drive belt drive comprising a main reel 17, a counterreel 18 and a drive belt 19.

In order to move the bed frame 2 with the exemplarily outlined mattress 3 from the night mode shown in FIG. 3 to the day mode, the carriages 6 must be moved vertically upwards by means of the rollers 7 and 8 along the guide rails 5. This is done by rotating the sprocket wheels 11 so that forces resulting in the respective desired movement are applied via the pull chains 9 to said carriages 6.

In order to prevent possible canting of the carriages 6 on the guide rails 5 during the up and down movement of the bed frame 2, the sprocket wheels 11 must be synchronized so that both carriages 6 will simultaneously be moved up or down along equal paths. The synchronization of the sprocket wheels 11 is carried out by means of a coupler rod 16 through which the two sprocket wheels are rigidly coupled with one another. A rotation of the coupler rod 16 will therefore cause a simultaneous and synchronous rotation of the sprocket wheels 11.

According to a specially preferred embodiment of the present invention, the coupler rod 16 is rotated by winding the drive belt 19 onto the main reel 17 and by unwinding it from said main reel. This has the effect that the main reel 17, which is rigidly connected to the coupler rod 16, is rotated, and, consequently, the coupler rod 16 will be rotated as well. When the drive belt 19 is wound onto and unwound from the main reel 17, this will have the effect that said drive belt 19 is simultaneously wound onto and unwound from the counterreel 18. The counterreel 18 is preferably rotated by means of a motor which is coupled to by a reduction gearing.

One advantage of the use of such belt drives is that they are known in the prior art and that they are used e.g. for light-blocking devices, such as roller shutters. Hence, these belt drives can be obtained at an essentially moderate price, since a comparatively ample series production exists.

Another advantage is to be seen in the use of these belt drives, since they permit a comfortable, simple and quiet operation of the lift bed 1 according to the present invention.

According to the variant shown in FIG. 3, the main reel 17 and the coupler rod 16 are not located on the same level so that the torque of the main reel 17 must be transmitted to the coupler rod 16 via an exemplarily outlined deflection pulley 20. In particular, a correspondingly low-powered motor can be used, since the forces to be applied can be minimized by the mass ratio between the counterweights 12 and the bed frame 2.

If the counterweights 12 have, in common, a mass that is larger than the mass of the bed frame 2, the sprocket wheels 11 and the coupler rod 16, respectively, must be caused to rotate by means of the drive belt 19 so as to move the lift bed 1 from the day mode to the night mode. For this purpose, the motor with the preceding reduction gearing will preferably rotate the counterreel 18 in such a way that the drive belt 19 is unwound from the main reel 17 and wound onto the counterreel 18. This has the effect that the reels 17, 18 as well as the sprocket wheels 11 and the coupler rod 16 are caused to rotate, whereby the weights 12 will be moved vertically upwards and the bed frame 2 will move downwards either until it has reached the night-mode position or until the motor is switched off by means of a switch provided for this purpose. If the bed frame 2 reaches the night mode without the motor having been switched off previously, the motor will switch off automatically; this can be controlled e.g. via a suitable sensor which, when detecting the bed frame 2 at the night-mode position, produces a respective control signal. Such a sensor or sensor system can also be used for switching off the motor when an object below the bed frame is detected during a downward movement of the bed frame 2 or when an object on said bed frame 2 is detected during an upward movement of said bed frame 2. The motor coupled to the reduction gearing is, in particular, implemented such that a self-locking effect is achieved on the basis of a high transmission so that the bed frame 2 will remain in the night-mode position and so that this self-locking effect will preferably only be eliminated by a renewed activation of the motor.

In order to move the bed frame 2 from the night-mode position to the day-mode position, the motor with the reduction gearing is preferably switched on, whereupon the drive belt 19 will be released by actuating a switch provided for this purpose, so that, due to the mass ratio between the counterweights 12 and the bed frame 2, said bed frame 2 can preferably move to the day mode without any necessity of driving the sprocket wheels 11 by means of the motor.

If the mass of the bed frame 2 should be larger than the sum of the masses of the counterweights 12, the sprocket wheels 11 must be put in motion by means of the drive belt 19 so as to move the bed frame 2 from the night-mode position to the day-mode position.

The main reel 17 and the counterreel 18 are preferably arranged in such a way that they can be installed in a countersunk mode and that the part of the drive belt extending between said main reel 17 and said counterreel 18 can, via respective guide means, be attached such that it is freely accessible for possible operation by hand. In the case of power failure, for example, the freely accessible part of the drive belt can therefore be operated manually so as to move the bed frame 2 up and down in a hand-operated mode.

According to an additional variant, the motor can be implemented as a tube motor operating preferably in a low-noise mode, said motor may having preferably a power of less than 100 watt.

Figure 4:
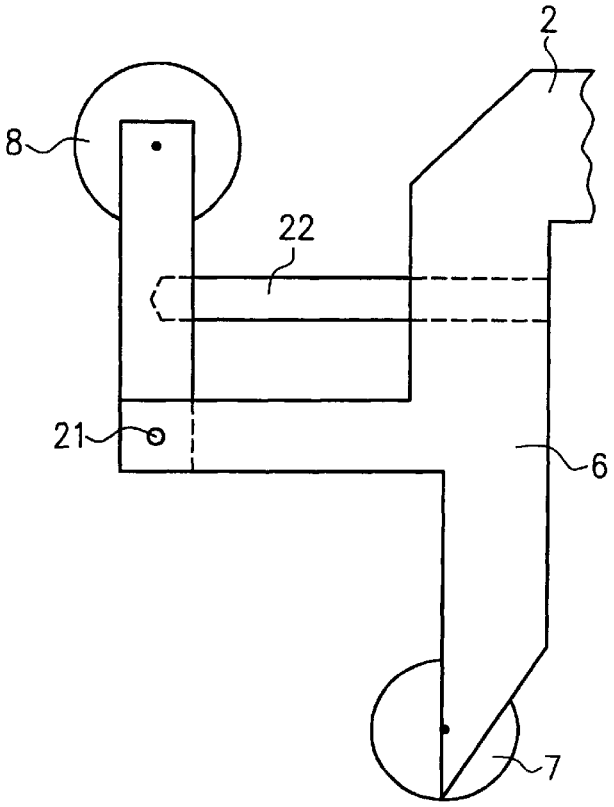
FIG. 4 a schematic side view of a carriage according to the present invention.

FIG. 4 shows a schematic side view of a carriage 6 according to the present invention, which is provided with rollers 7 and 8. The carriage 6 is rigidly coupled to the bed frame 2 and divided into two parts which are interconnected by an axle 21. Each of the two parts is provided with one roller 7, 8, and the part provided with roller 8 is supported such that it is adapted to be tilted relative to the part provided with roller 7, said first-mentioned part being tiltable about an axis extending parallel to said axle 21. In addition, the two parts are interconnected preferably through an adjusting device 22 by means of which said two parts can be adjusted relative to one another. It can therefore be guaranteed that the bed frame 2 is oriented horizontally relative to the floor of the room.

Figure 5:
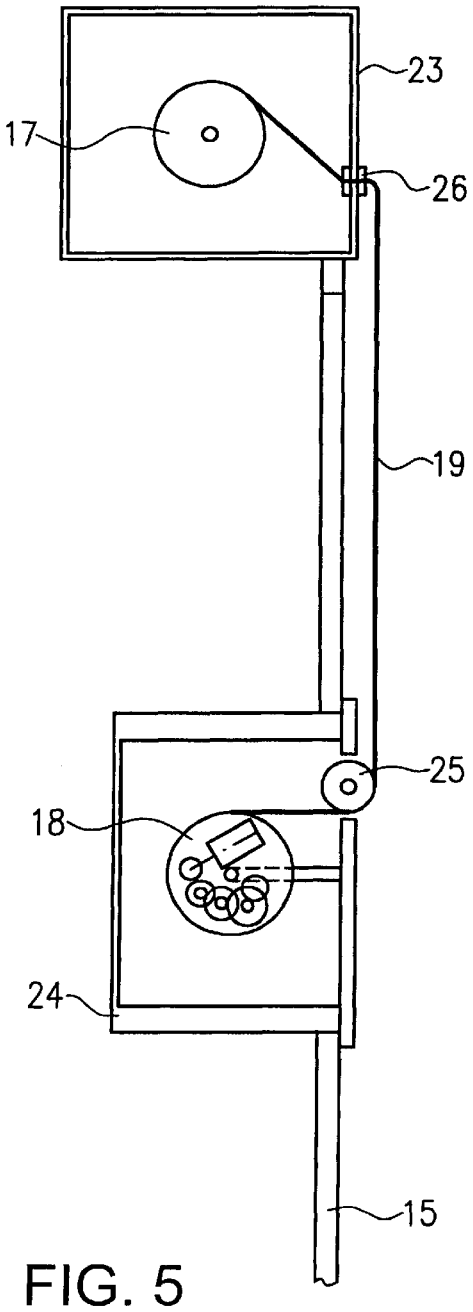
FIG. 5 a schematic side view of a belt drive according to the present invention.

FIG. 5 shows a schematic side view of a belt drive according to the present invention, comprising the drive belt 19, the main reel 17, the counterreel 18. The main reel 17 is vertically spaced from the counterreel 18. Both the main reel 17 and the counterreel 18 are preferably adapted to be installed in a countersunk mode, and, as exemplarily indicated in FIG. 5, they can each be installed in a suitable box 23, 24 and sunk e.g. into the wall 15.

According to another variant, the boxes 23, 24 can be sunk into a guide means 4 of the lift bed.

In particular, the part of the drive belt 19 extending between said main reel 17 and said counterreel 18 can, via respective guide means 25, 26, be attached such that it is freely accessible for possible operation by hand.

What is claimed is:

1. A lift bed comprising:

a vertically adjustable bed frame;

a pulling device for moving said bed frame in the vertical direction;

two carriages secured to an end face of the bed frame horizontally spaced from one another; and each of said carriages is supported to be movable on a vertical guide rail by means of rollers, wherein the two carriages are each connected via a pull chain or a toothed belt to a counterweight;

each pull chain or each toothed belt is guided over a drive wheel at the upper end of the respective guide rail;

the drive wheels are rigidly coupled via a coupler rod;

the coupler rod is connected to a main reel arranged in vertically spaced relationship with a counterreel;

the main reel and the counterreel are interconnected by a drive belt, said drive belt being used for rotatably driving the coupler rod; and the counterreel is adapted to be driven selectively in one direction or the other by means of a motor coupled to a reduction gearing and used for rotating the coupler rod.

2. The lift bed according to claim 1, wherein the main reel and the counterreel are arranged to be installed in a countersunk mode and the part of the drive belt extending between said main reel and said counterreel is attachable via respective guide means to be freely accessible for a possible operation by hand.

3. The lift bed according to claim 1, wherein the carriages are each bipartite, each part comprising at least one roller and the two parts of a carriage being interconnected in such a way that one part is adapted to be tilted relative to the other part about a horizontal axis extending parallel to the coupler rod.

4. A lift bed comprising:

a vertically adjustable bed frame;

a pulling device for moving said bed frame in the vertical direction;

two carriages secured to an end face of the bed frame horizontally spaced from one another, and each of said carriages is supported to be movable on a vertical guide rail by means of rollers, wherein the two carriages are each connected via a pull chain or a toothed belt to a counterweight;

each pull chain or each toothed belt is guided over a drive wheel at the upper end of the respective guide rail;

the drive wheels are rigidly coupled via a coupler rod;

the coupler rod is connected to a main reel which is arranged in vertically spaced relationship with a counter-reel;

the main reel and the counter-reel are interconnected by a drive belt, said drive belt being used for rotatably driving the coupler rod; and the counter-reel is adapted to be driven selectively in one direction or the other by means of a motor coupled to a reduction gearing implemented as a self-locking component and used for rotating the coupler rod.

5. The lift bed according to claim 4 wherein the motor is implemented as a tube motor.

6. The lift bed according to claim 4 wherein the motor is implemented such that its rated power does not exceed 100 W.

7. A lift bed comprising:

a vertically adjustable bed frame;

a pulling device for moving said bed frame in the vertical direction;

two carriages secured to an end face of the bed frame horizontally spaced from one another, and each of said carriages is supported to be movable on a vertical guide rail by means of rollers, wherein the two carriages are each connected via a pull chain or a toothed belt to a counterweight;

each pull chain or each toothed belt is guided over a drive wheel at the upper end of the respective guide rail;

the drive wheels are rigidly coupled via a coupler rod;

the coupler rod is connected to a main reel which is arranged in vertically spaced relationship with a counter-reel;

the main reel and the counter-reel are interconnected by a drive belt, said drive belt being used for rotatably driving the coupler rod; and the counterreel is adapted to be driven selectively in one direction or the other by means of a motor coupled to a reduction gearing and used for rotating the coupler rod, and wherein the carriages are each bipartite, each part comprising at least one roller and the two parts of a carriage being interconnected in such a way that one part is adapted to be tilted relative to the other part about a horizontal axis extending parallel to the coupler rod and each carriage is provided with an adjusting device by means of which the two parts can be adjusted relative to one another.

8. A lift bed comprising:

a vertically adjustable bed frame;

a pulling device for moving said bed frame in the vertical direction;

two carriages secured to an end face of the bed frame horizontally spaced from one another, and each of said carriages is supported to be movable on a vertical guide rail by means of rollers, wherein the two carriages are each connected via a pull chain or a toothed belt to a counterweight having a weight that exceeds that of the bed frame;

each pull chain or each toothed belt is guided over a drive wheel at the upper end of the respective guide rail;

the drive wheels are rigidly coupled via a coupler rod;

the coupler rod is connected to a main reel which is arranged in vertically spaced relationship with a counterreel;

the main reel and the counterreel are interconnected by a drive belt, said drive belt being used for rotatably driving the coupler rod; and the counterreel is adapted to be driven selectively in one direction or the other by means of a motor coupled to a reduction gearing implemented and used for rotating the coupler rod, and wherein the mass of the counterweight is one of exceeding and being less than the mass of the bed frame.

* * * * *

UNITED STATES PATENT AND TRADEMARK OFFICE

CERTIFICATE OF CORRECTION

PATENT NO. : 6,550,081 B2
DATED : April 22, 2003
INVENTOR(S) : Gerhart W. Vilsmeier It is certified that error appears in the above-identified patent and that said Letters Patent is hereby corrected as shown below:

Title page,
Item [30], Foreign Application Priority Data, delete "Oct. 30, 2002" and substitute with -- Oct. 30, 2000 --

Signed and Sealed this

Twenty-third Day of September, 2003

JAMES E. ROGAN
*Director of the United States Patent and Trademark Office*